United States Patent [19]

Leonard

[11] Patent Number: 4,958,163

[45] Date of Patent: Sep. 18, 1990

[54] MEANS FOR TUNING AN ANTENNA

[75] Inventor: Peter F. Leonard, 11 Cole Street, Klemzig, Australia, 5087

[73] Assignees: Peter F. Leonard; Leonie A. Leonard, both of Klemzig, Australia

[21] Appl. No.: 305,292

[22] Filed: Feb. 1, 1989

[30] Foreign Application Priority Data

Feb. 1, 1988 [AU] Australia ..... PI6518

[51] Int. Cl.[5] ..... H01Q 9/000

[52] U.S. Cl. ..... 343/745; 343/750

[58] Field of Search ..... 343/713, 715, 749, 750, 343/787, 900, 745

[56] References Cited

U.S. PATENT DOCUMENTS 2,961,657 11/1960 Hodges et al. ..... 343/900
3,611,390 10/1971 Chiron ..... 343/750
3,671,972 6/1972 Spilsbury et al. ..... 343/750
4,063,206 12/1977 Walker, III ..... 343/750
4,097,867 6/1978 Eroncig ..... 343/750
4,214,246 7/1980 Arechavala ..... 343/750

*Primary Examiner*—Rolf Hille
*Assistant Examiner*—Peter Toby Brown
*Attorney, Agent, or Firm*—Edward W. Callan

[57] ABSTRACT

An antenna comprising a radiating element, a tuning coil having a rod located coaxially within the coil and positionable along the longitudinal axis of the tuning coil, the rod having a wiper attached which urges against the internal surface of the coil and means for positioning the rod such that with the coil connected to a radiating element and the wiper connected to a radio frequency transceiver, tuning of the antenna can be effected by control of the positioning means to adjust the position of the wiper along the tuning coil.

7 Claims, 4 Drawing Sheets

MEANS FOR TUNING AN ANTENNA

This invention relates to a means for varying inductance found particularly useful for tuning an antenna which receives and transmits radio frequencies.

BACKGROUND OF THE INVENTION

A number of important criteria must be met when designing a radio frequency antenna for mobile use. These criteria fall within two major categories namely electrical and mechanical. Of the electrical characteristics, Frequency Bandwidth, Voltage Standing Wave Ratio (VSWR) at various frequencies, power gain of tranmission and reception, impedance match at various frequencies, polarisation, receive/radiation pattern, radiation and radiant power transmission and loss characteristics, tunability and repeatability are considered important. Of the desirable mechanical characteristics size, weight, robustness, minimization of vibration induced noise sources, vibration rating, weather resistance and configuration of radiating and reflector elements are considered important.

These criteria assume increased or decreased importance dependent on the frequency bandwidth and ground plane conditions required of the transceiver and antenna system.

This invention relates particularly to those antennas which are required to operate in portions of the electromagnetic frequency spectrum which require an optimum antenna length that cannot be physically supported as in the circumstances of a mobile transceiver and its vehicle mounted antenna.

An antenna has an equivalent circuit configuration comprising a capacitance and resistance in series which physically comprises a wire or metallic body commonly referred to as the radiating element. For a vehicle mounted antenna the radiating element is usually orientated vertically, however, for operation in the High Frequency band, the antenna must be physically of lesser length than the optimum quarter wave length, and therefore requires inductance.

The inductance element resonates with the antenna inductance and capacitance at the operating frequency to provide a resistive impedance for the transceiver. As the antenna is required to operate over a wide frequency range this inductance must be variable to achieve resonance over the required range.

The most robust arrangement is the use of a fixed inductance, which however only provides a narrow frequency bandwidth of optimum operation. Also well known is the use of variable inductance which ideally provides a broader frequency bandwidth.

Commonly used to provide a variable inductance means, is an arrangement of coils used singly or in combination (ganged). However, the physical size of these coils and their enclosure prohibits adjacency to the antenna and requires manual or automatic adjustment of the coil combinations to achieve tuning for specific frequencies. Their large size also creates an installation problem, as space is usually at a premium in mobile conditions and thus frequency bandwidth is ultimately restricted.

Thus it is also known to position an inductive coil or coils of suitable dimensions and wire size onto the top, intermediate or bottom of an antenna. These coils are mounted coaxial with the antenna's radiating element and if a fixed inductance is used, they may, dependent on their configuration, provide high gain for a narrow frequency bandwidth or lower gain for a broader frequency bandwidth while concommitantly affecting the receive/radiation pattern in conjunction with the voltage and current distribution. The impedance of the antenna also depends upon the diameter and configuration of wire conductor in relation to wavelength. If the diameter of the conductor is increased, the capacitance per unit length increases and the inductance per unit length decreases. Since the radiation resistance is little affected, the decreased inductance/capacitance ratio causes the Q of the antenna to decrease, so that the resonance curve becomes less sharp and hence the antenna is capable of operating over a wide frequency range. The Q of an equivalent circuit is given by the following:

$$Q = wL/R_s$$

where $w = 2\pi$ times frequency;

$L$ = inductance; and $R_s$ = the effective resistance of the circuit.

If variable inductance means are employed, the electrical characteristics of frequency bandwidth are kept as broad as possible, the V.S.W.R. is minimized for each of the infinite frequencies achievable within the bandwidth provided, the gain of the antenna is as high as possible across the bandwidth provided, Q is kept as high as possible, impedance is matched across the frequency bandwidth, the radiation pattern of the commonly vertical polarization receiving/radiating element is omnidirectional in the horizontal plane and achieves the broadest coverage of the azimuthal plane, allows the highest possible level of radio frequency energy to be transmitted and ensures timely, accurate and repeatable tuning of the antenna to the desired frequency.

In addition to the above ideal electrical characteristics, the antenna must also exhibit manageable mechanical attributes such as a size which allows mounting on to the mobile platform, a weight as low as possible to minimize both the inertia of the antenna, and the required strength of the mounting means. An antenna employing variable inductance means for tuning must also be particularly robust in its mechanical working since any movement of contacts will directly affect the tuning of the antenna.

In the prior art, variable inductance means has comprised a coil positioned at the base of a whip antenna element, having a wiper contact that is adjustable either manually or automatically along the external length of the coil, which also exhibits the following problems and fails to meet ideal design criteria for a mobile antenna.

In fact, there exist a number of electrical and mechanical problems which arise as a consequence of the use of this configuration. Commonly the large degree of both high and low frequency vibration which is experienced in all planes of movement impart both a strain on the top of the coil and wiper contact resulting in physical departure of the contact from the coil or along the coil. This has the effect in the first instance of adding noise to both received and transmitted signals while in the second instance changes the tuned frequency from that desired by the transceiver. The bulky nature of the external wiper adds significantly to the turning moment of the mounted antenna and adds additional weight and size to the antenna configuration.

Some prior art antennae exhibit spurious resonance which is not a consequence of the transmitter output but rather a resultant product of the combination of unused coil, capacitance and stray radio frequency energy. This spurious resonance is also present during receive periods and both occurrences can affect antenna gain and transceiver performance in particular by decreasing the Q of the antenna and heating up the unused inductance.

It is a further characteristic of prior art antennae that the movement of the external wiper becomes very critical within specific zones of the coil and stable frequency tuning relies on the constant positioning of the wiper on the coil to an extent greater that can be provided.

External wiper arrangements require mechanically complex movement mechanisms and additionally require them to be protected and shielded from mechanical damage.

Therefore, it is an object of this invention to provide an antenna having a means for varying inductance for tuning an antenna which receives and transmits radio frequencies and which overcomes the abovementioned problems associated with the prior art.

It is an aspect of the invention to provide an antenna having characteristics which meet or exceed prior art antenna performance specifications which employs variable inductance means for tuning.

A further aspect of the invention is to provide an antenna having a coil with a moveable wiper positionable along the coil which simplifies the construction and operation of such an antenna.

A still further aspect of the invention comprises an antenna according to the above description wherein the method of manufacturing the tuning coil further comprises the use of a mandrel, wherein a pair of tubes of insulating material are located on each end of the mandrel whereupon an intermediate portion of the mandrel is left exposed, and a coil of electrical conducting material is wound onto the intermediate portion of the mandrel, so as to form a tuning coil, whereupon a chemically setting resinous material is placed over the external surface of the coil and a further tube of insulating material is then positioned over the external surface of the tuning coil. The further tube extends over a portion of each of the first mentioned tubes, such that the resinous material adheres the further tube both to the coil and the first said tubes. Once the resinous material has set, the mandrel can be removed, and in order to ease the removal of the mandrel, a mould release agent can be applied to the mandrel prior to winding of the coil. Once the mandrel has been removed, the internal surface of the tube can be honed so as to remove any surplus resinous material or insulating material surrounding the coil, thereby exposing a conducting surface of the wire coil.

Yet a further aspect of the invention comprises an antenna tuning coil manufactured according to the above description wherein the coil of electrical conducting material is wire wound in a single helical configuration or in combination with a plurality of helically wound wires of different diameter in parallel and contiguous with each other and joined at the beginning and end of the helically wound wire. This arrangement can maintain the broadband characteristics of the antenna while keeping the Q high.

BRIEF SUMMARY OF THE INVENTION

In its broadest form, the invention comprises an antenna comprising a circular helically wound tuning coil having a curved inner surface, a rod assembly located coaxially within the coil and slidably positionable along the longitudinal axis of the tuning coil, said rod assembly comprising a support means, at least one resilient wiper means on said support means, said resilient wiper means having an outer surface curved with the same radius of curvature, and in the same plane as the coil inner surface, the resilience of the wiper means urging the outer surface of the wiper means to conform with, and into contact with, at least a portion of the coil inner surface, means for positioning the rod assembly longitudinally within the coil, electrical connection means and a conductor electrically connecting said wiper means to said connection means, whereby continuous tuning of the antenna tuning assembly can be effected by positioning the wiper means along the tuning coil.

BRIEF DESCRIPTION OF THE DRAWINGS

In order that the invention may be more clearly understood, reference will now be made to an embodiment of the invention and to the accompanying drawings, wherein:

FIG. 2 shows a side elevation of the annular rings and springs attached to a rod member;

Antennas of this type are normally used in a vertical orientation mounted to a vehicle, however, FIG. 1 shows the antenna tuning means which normally resides at the base of the antenna on its side with the top of the antenna tuning means shown on the left hand side of the figures. Referring to FIG. 1 there is shown a positionable rod assembly having a wiper 12 that is in sliding contact with the internal surface of a tuning coil 13.

Figure 1:
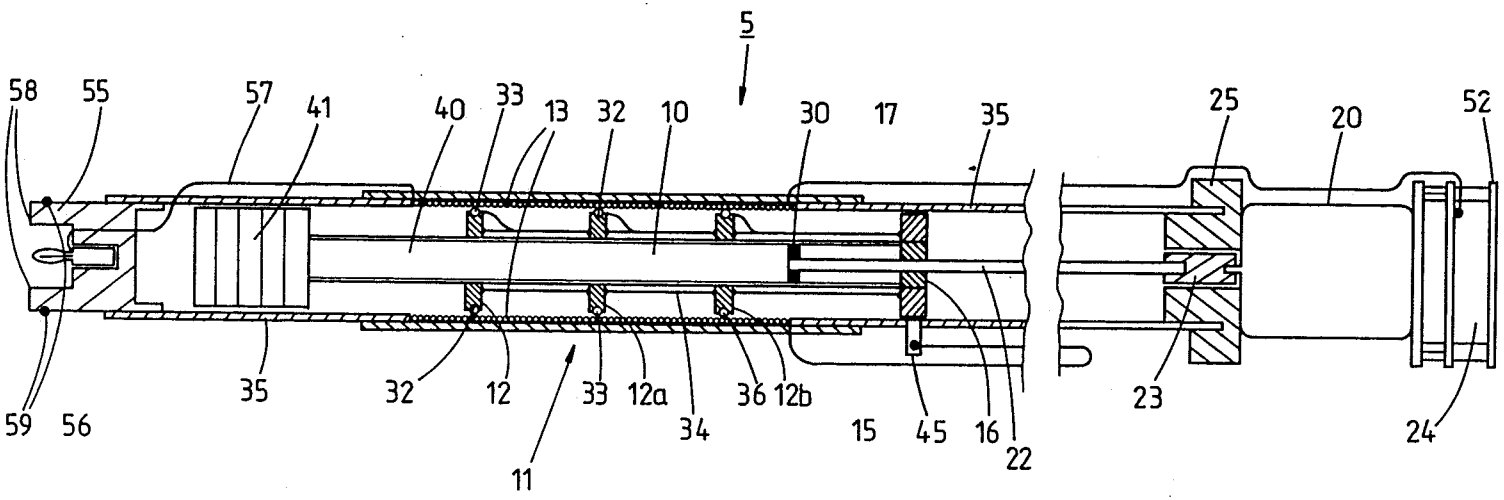
FIG. 1 shows a cross-sectional view of the antenna tuning means.
Figure 7:
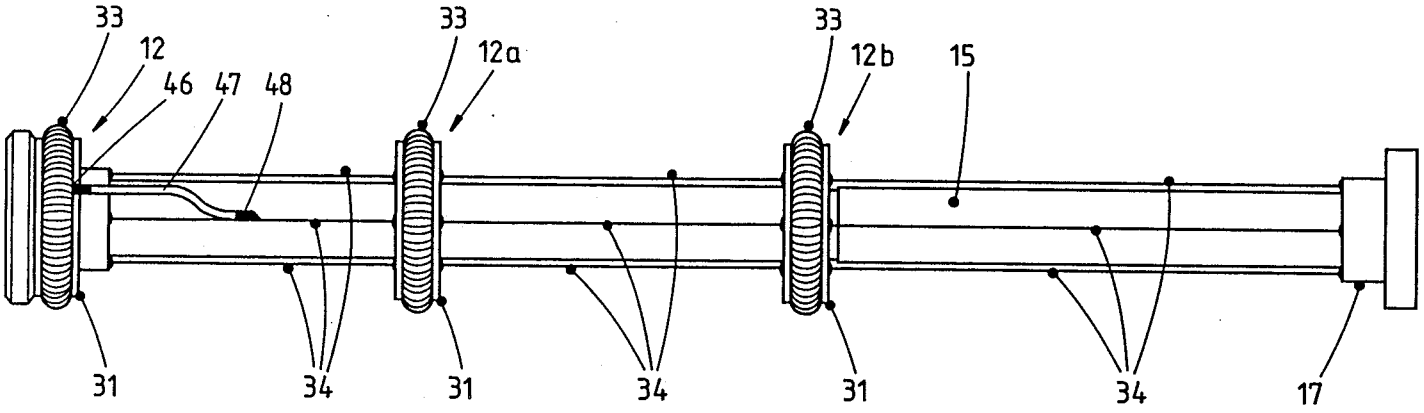

The positionable rod assembly 10 comprises a tube 15 to which wiper supports 12, 12*a* and 12*b* are attached. The non-conductive tube 15 at its lower end is provided with a non-conductive threaded portion 16 having an external flange member 17 that slides within a tube 35 so as to centrally locate the tube 15. Non-conductive material is used to minimize the unwanted capactive effect of conductive materials located within the coil. Attached to the external flange member 17 is a sliding yoke 45 which is conductive to the external flange member and permits attachment of conductive wire.

There is provided a motor 20. Preferably the motor is a stepper motor driven under software control and drives a threaded shaft 22, the threaded shaft engaging a threaded portion 16 of the positionable rod member 10. The motor drives the threaded shaft 22 via coupling 23, and the operation of the motor 20 is controlled via a microprocessor and control circuitry 24. Rotation of the shaft 22 moves the positionable rod member 10 up or down the coil 13 while the wipers maintain sliding contact with the internal surface of the tuning coil 13. Control of the motor 20 via the microprocessor and control circuitry 24 positions the rod assembly 10 in accordance with the required inductance for the desired transmit and receive frequency. The motor 20 is mounted to a mounting block 25 and in turn the tube 35 is also mounted to the mounting block 25. The end of the threaded shaft 22 is provided with a sliding bush 30 that is locatable within the tube 15. The bush is provided so as to prevent movement of the threaded shaft from a coaxial position within the tube 15 and is designed to minimize friction laterally along the inside of the tube 15 and rotationally at the threaded portion 16 of the tube and assist accurate and stable location of the rod assembly 10 within the coil.

As shown in FIGS. 1 and 2 the wiper supports 12, 12*a* and 12*b* each comprises an annular ring 31 which is preferably made of brass and fixedly attached to the external surface of the tube 15. Each of the wiper supports 12, 12*a* and 12*b* has an annular groove 32 on which a metal annular spring 33 is located. Each spring 33 extends around the circumference of the annular groove 32, and is sized such that when the wiper supports 12, 12*a* and 12*b* are located within the tube 11 the springs 33 are urged against the internal surface of the coil 13 which is exposed to the springs.

Conductivity between the metal springs 33 and the annular rings 31 is assured. Stiff wire rods 34 connect the annular rings 31 to each other and to the external flange member 17 which completes a conductive circuit to the sliding yoke 45. This arrangement is the electrical contact that connects the antenna tuning coil to the transceiver and the transceiver's grounding structure. This particular connection arrangement is designed so as to minimize any capacitive effects between the rod assembly 10 and the coil 13.

When the rod member 10 is located in the upper portion of the tuning coil 13 as shown in FIG. 1, small amounts of movement are required to effect a frequency change in comparison to lower positions in the tuning coil 13 where a greater amount of movement is required to effect a frequency change. The coil and wipers form an air cored inductive tuning component, however, by optionally introducing a ferro-magnetic material into the interior of the coil the extent of movement required for frequency change can be decreased. This is particularly useful at the lower positions of the rod member 10 within the tuning coil 13 which generally is associated with the low frequency response of the antenna.

Therefore, in order to effect both air coring and ferro-magnetic coring of the tuning coil 13 there is provided a non-conductive plastic spacer 40, and in turn a ferro-magnetic slug 41. The plastic spacer 40 and the ferro-magnetic slug 41 are mounted on the upper end of the rod member 10. As the rod member 10 moves down the tuning coil 13, the ferro-magnetic slug 41 is gradually introduced into the interior of the coil 13 and which alters the tuning characteristics of the coil such that less movement is required to effect frequency change. Preferably, the ferro-magnetic slug 41 can be graduated in terms of its permeability thereby having an increasing effect on the tuning coil 13 as the higher permeability material at the top of the ferro-magnetic slug 41 is introduced into the coil i.e. by increasing the Q of the antenna. This arrangement however, adds to the inertia of the antenna tuning means and is used optionally in appropriate circumstances.

Figure 4:
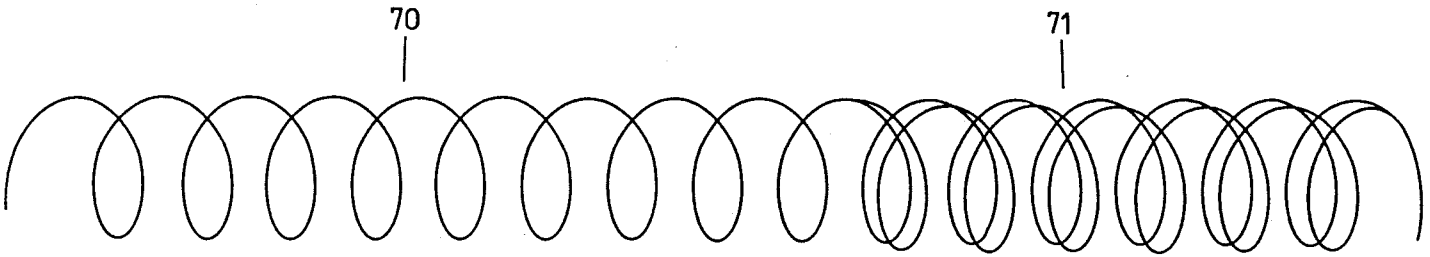
FIG. 4 shows an external view of a double helix tuning coil combined with a single helix winding.

FIG. 4 shows pictorially a tuning coil having a single wire wound in a helix 70 at its lower end and a double helix of wire 71 at its upper end. The gauge of wire can be different at each end and it has been found that a number of substantial benefits results from this configuration. Firstly the Q of the antenna is found to be higher for the range of frequencies at the higher end of the antenna's bandwidth. Secondly, it is found that the efficiency of the antenna is higher, that is, the ratio of RF energy input to the RF energy output is high thus indicating a decrease in resistive thermal losses. This is a result of the greater conductive area exposed by the configuration of the windings. In this embodiment, it results in a number of advantages comprising an ability to tune the antenna over the available frequencies while maintaining a high Q with larger travel per frequency increment and secondly, since the mechanical wiper action acts over a larger and substantially smoother surface area there is less electrical noise and greater repeatability of tuning frequencies within the bandwidth of the antenna. Conversely, a less accurate mechanical positioning means has less effect on tuning than is otherwise achievable. A plurality of parallel wires in place of the double helix of wire at the tuning coils upper end with a higher gauge of wire has also been found to have similar results.

FIGS. 1 and 2 show second and third wiper members 12*a* and 12*b* respectively, these additional wipers are located below the main wiper 12. The purpose of these contacts is to create a range of inductance values with the unused portion of the tuning coil 13 which prevents the coil's lower section becoming resonant in a frequency band which would affect the operation of the antenna or transceiver. One or more of these additional wipers may be used to create this effect.

FIG. 2 also shows a connection between a wire 47 and the metal spring 33 at 46. Wire 47 is bonded to the stiff wire rods 34 so as to electrically connect the metal spring 33 to the wire rods 34 so as not to require sole reliance on the connection between the spring 33 and the disc 31. The connection between the spring and the disc can become electrically noisy and add to back lash of the positionable rod member if the spring 33 is slightly over large for the disc and conversely will not freely wipe the coil if too tightly sprung on the disc.

Preferably, the above configuration is used, since the location of the wipers, rods, shafts and motor are centrally located and generally low in relation to the antenna height which ensures a low center of gravity, and an equalization of vibrational and torque forces on the electrical contact surfaces.

Figure 3:
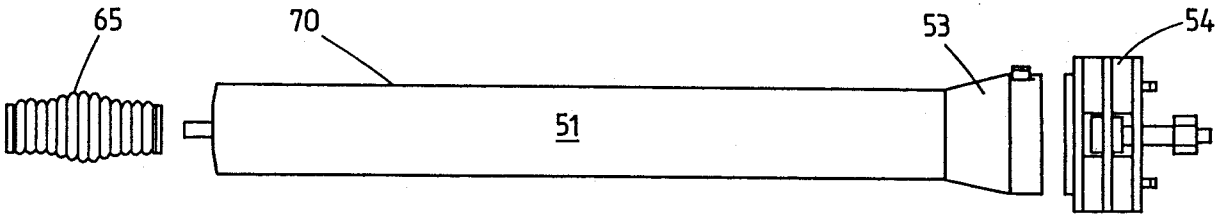
FIG. 3 shows an external view of the antenna tuning coil radome.

It is preferable that the coil assembly 5 be mounted within a protective casing of the type shown in FIG. 3. It is also preferable that there be only two main fixing points at its top in the vicinity of annular groove 61 and bottom in the vicinity of plate 52 and radome base 53 and that these two points be firmly set in relation to each other by the radome construction so that there is a minimization of any flexing of the coil assembly 5.

Figure 3A:
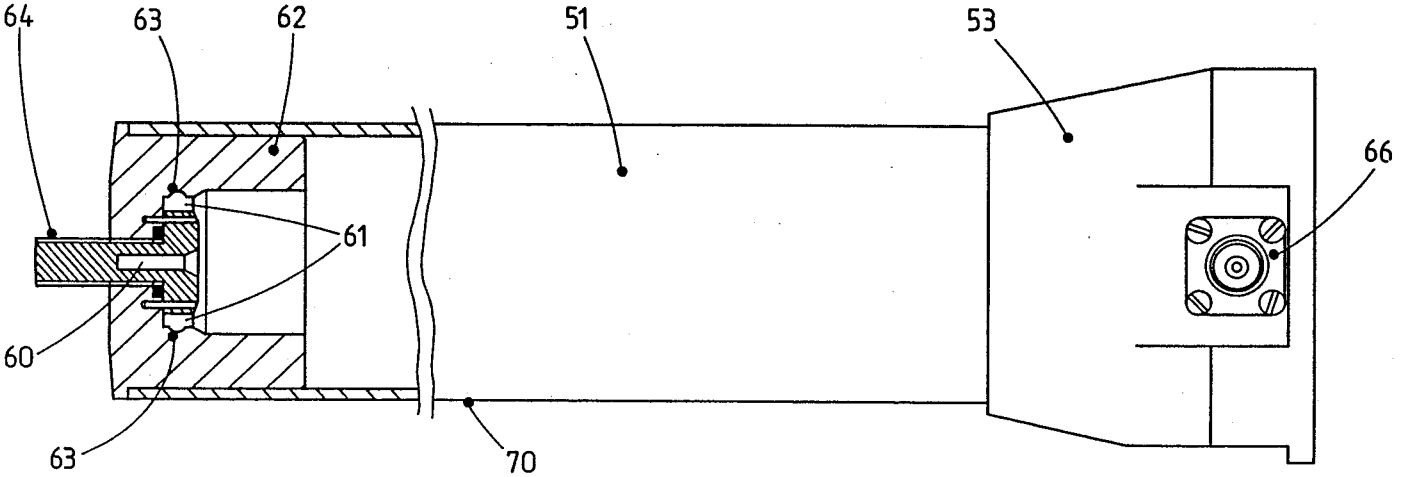
FIG. 3*a* shows a partially exposed view of the antenna tuning coil radome and tuning means.

Plate 52 shown in FIG. 1 is firmly attached to a radome base 53. The exterior of the radome is shown in FIGS. 3 and 3*a*. At the top of the coil assembly 5 a plug device housing 55 is bonded to the top tube 35 of the coil assembly and it has inserted therein a banana type plug 56 which loosely occupies the insertion hole. This loose arrangement assists location of this plug into a corresponding apperture 60 in the inner top of the radome 51 as shown in FIG. 3*a*. Electrical connection between the coil 13 and the banana plug 56 is via wire 57. A rim 58 of the plug device housing 55 fits into a corresponding annular groove 61 in the inner top of the radome 51. A radome 70 is attached to the radome base 53 and extends over the coil assembly 5 to a plug 62 shown on FIG. 3*a*. The inner shape of the plug 62 is shaped to accommodate the plug device housing 55 of the coil assembly 5. To assist the frictional positioning and water sealing of the plug device housing 55, 'o' rings 59 are located near the periphery of the rim 58 and locate into a corresponding annular groove 63 within the plug 62.

Plug 62 also serves to restrict environmental access to the coil assembly 5. A conductive threaded stub 64 is exposed on the top of the radome structure which is in electrical contact with the banana type plug 56. As shown on FIG. 3, a spring 65 may be screw attached to the stub 64. Thereupon an antenna (not shown) may be then attached on top of the spring 65 or alternatively the antenna may be directly attached to the threaded stub 64. As will be appreciated, the strength of the tube 55, the radome-base 53 and the plug 62 need to be sufficient to maintain rigidity under extreme vibrational and erratic movement, stressed further by the fitment of a 2 to 3 meter whip antenna which creates a large amount of turning moment on the attachment point of the antenna to the radome and also the radome to the vehicle.

A coaxial socket connector 66, is supplied on the radome base 53 for connection of a radio frequency conduction wire from the transceiver to the antenna.

A further wire (not shown) connects the antenna's microprocessor and control circuitry 24 to the transceiver so that appropriate antenna tuning can be conducted, based on the selections of channel made on the transceiver.

The claims defining the invention are as follows; I claim:

1. An antenna tuning assembly comprising a circular helically wound tuning coil having a curved inner surface, a rod assembly located coaxially within the tuning coil and sildably positionable along a longitudinal axis of the tuning coil, said rod assembly comprising a support means, at least one resilient wiper means on said support means, said resilient wiper means having an outer surface curved with a same radius of curvature, and in a same plane as the curved inner surface of said coil, the resilience of the wiper means urging the outer surface of the wiper means to conform with, and into contact with a plurality of points of contact extending around the circumference of the curved inner surface of the tuning coil, whereby continuous tuning of the antenna tuning assembly can be effected by positioning the wiper means along the tuning coil.

2. An antenna tuning assembly according to claim 1 wherein a plurality of said wiper means are supported along the support means, and electrical connection means are connected to each of said plurality of wiper means, whereby frequencies generated by the rod assembly in use are generated below a tuned frequency of the antenna tuning assembly.

3. An antenna tuning assembly according to claim 1 wherein said wiper means comprises an annular ring supported by the support means, a groove extending around the outer surface of the annular ring in which an electrically conductive spring is located and which urges against the curved inner surface of the tuning coil.

4. An antenna tuning assembly according to claim 1, further comprising means for positioning the rod assembly within the tuning coil, wherein the tuning coil has a bottom end closest to the positioning means and a top end furthest from the positioning means, and comprises a winding of wire in a single helix arrangement having a greater gauge at its top end than at its bottom end.

5. An antenna according to claim 2, further comprising means for positioning the rod assembly within the tuning coil, wherein the rod assembly has an upper end to which is attached a ferromagnetic material having a permeability which is increasing along its length from the upper end of the rod assembly, whereby said ferromagnetic material moves into the tuning coil as the rod assembly moves towards the positioning means and increases the Q of the antenna.

6. An antenna tuning assembly according to claim 2, further comprising means for positioning the rod assembly within the tuning coil, wherein the rod assembly comprises a non-conductive threaded portion which is threadingly engaged to a threaded shaft, and said threaded shaft is rotationally driven by said positioning means comprising a motor, whereby rotation of the threaded shaft by the motor moves the rod assembly along the longitudinal axis of the tuning coil.

7. An antenna tuning assembly comprising a circular helically wound tuning coil having a curved inner surface, a rod assembly located coaxially within the tuning coil and slidably positionable along a longitudinal axis of the tuning coil, said rod assembly comprising a support means, at least one resilient wiper means on said support means, said resilient wiper means having an outer surface curved with a same radius of curvature, and in a same plane as the curved inner surface of the tuning coil, the resillence of the wiper means urging the outer surface of the wiper means to conform with, and into contact with a plurality of points of contact extending around a circumference of the curved inner surface of the tuning coil, wherein the tuning coil comprises a helical winding of wire having at least two wires in parallel helix form along a top portion of a length of the coil and a single helix form along a remaining portion of the coil length, whereby continuous tuning of the antenna tuning assembly can be effected by positioning the wiper along the tuning coil.

* * * * *